United States Patent [19]

Assad et al.

[11] Patent Number: 4,993,859

[45] Date of Patent: Feb. 19, 1991

[54] LIQUID APPLICATOR VALVE STRUCTURE

[75] Inventors: David A. Assad, West Falls; Larry R. Hironimus, Marion; David Meyer, Kenmore, all of N.Y.

[73] Assignee: Truly Magic Products, Inc., Buffalo, N.Y.

[21] Appl. No.: 540,455

[22] Filed: Jun. 19, 1990

Related U.S. Application Data

[63] Continuation of Ser. No. 356,751, May 24, 1989, abandoned.

[51] Int. Cl.[5] ..... A47L 13/17; A47L 23/05

[52] U.S. Cl. ..... 401/206; 401/264; 401/266; 401/273; 401/281

[58] Field of Search ..... 401/206, 264, 266, 281, 401/273

[56] References Cited

U.S. PATENT DOCUMENTS

| | | | |
|---|---|---|---|
| 1,401,508 | 12/1921 | D'Alessandro | 401/281 X |
| 2,080,778 | 5/1937 | Moine et al. | 401/206 |
| 2,975,465 | 3/1961 | Lerner et al. | 401/206 |
| 2,996,750 | 8/1961 | Cholet | 401/206 |
| 3,296,649 | 1/1967 | Schwartzman | 401/206 |
| 3,410,645 | 11/1968 | Schwartzman | 401/206 X |
| 3,468,611 | 9/1969 | Ward | 401/206 X |

FOREIGN PATENT DOCUMENTS

| | | | |
|---|---|---|---|
| 1492050 | 7/1967 | France | 401/206 |
| 25245 | 4/1963 | German Democratic Rep. | 401/281 |
| 563371 | 5/1957 | Italy | 401/281 |
| 636288 | 4/1950 | United Kingdom | 401/281 |

*Primary Examiner*—Steven A. Bratlie

*Attorney, Agent, or Firm*—Joseph P. Gastel

[57] ABSTRACT

A liquid applicator including a valve body for insertion into the neck of a liquid container, a duct in the valve body, a resilient web formed integrally with the valve body and extending transversely across the duct, a valve seat on one end of the valve body, a valve member secured to the resilient web and having a valve biased into engagement with the valve seat at the end of the valve body, a coating member mounted on the opposite end of the valve body, and a valve stem on the valve member located proximate the coating member for being deflected when the coating member is compressed onto an external surface to thereby unseat the valve and permit liquid to flow through the duct onto the coating member.

13 Claims, 2 Drawing Sheets

Fig. 5.
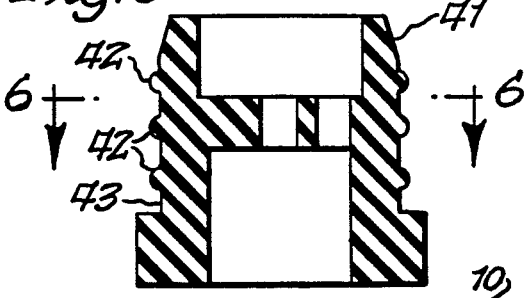
Fig. 6.
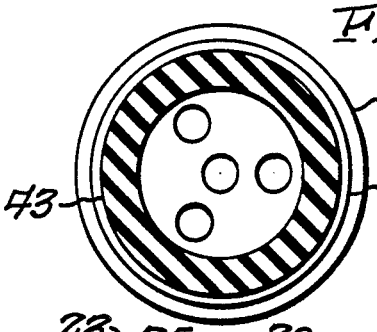
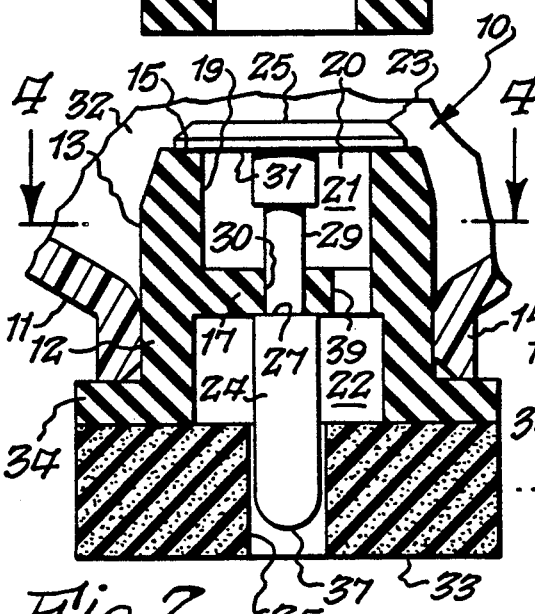
Fig. 2.
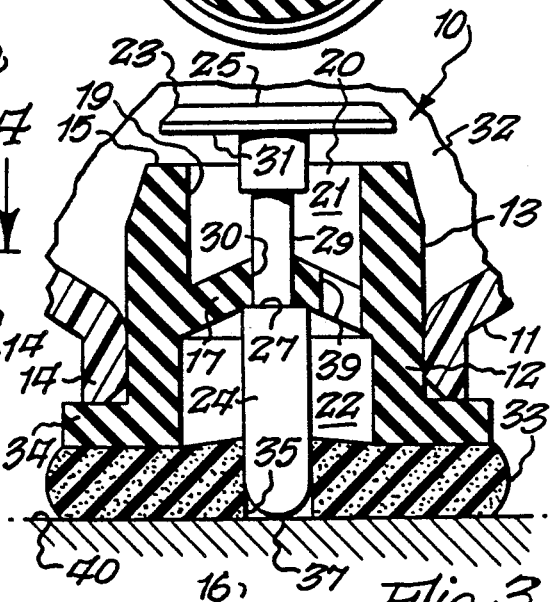
Fig. 3.
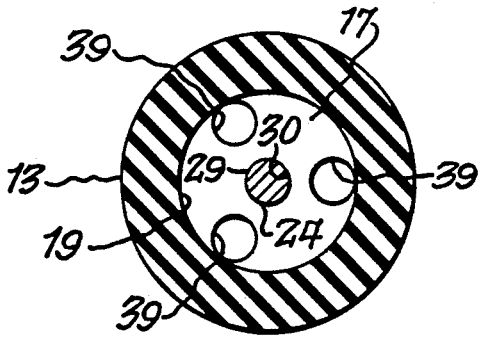
Fig. 4.
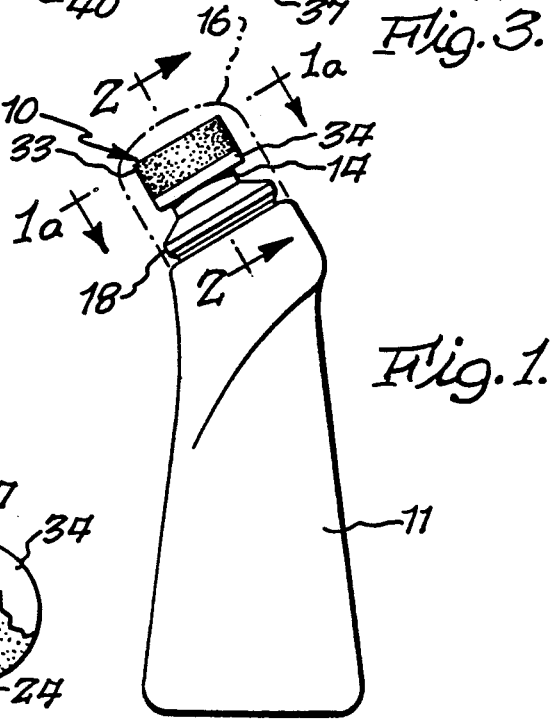
Fig. 1.
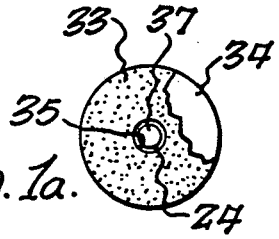
Fig. 1a.

LIQUID APPLICATOR VALVE STRUCTURE

This application is a Continuation of application Ser. No. 356,751, filed May 24, 1989 now abandoned.

BACKGROUND OF THE INVENTION

The present invention relates to an improved liquid applicator for various types of liquids.

Various types of liquid applicators have been known in the past. However, they had various deficiencies. Certain applicators could not positively seal the container in which they were located against undesired flow therefrom. Other applicators were relatively complex. Still other applicators could easily become clogged. Other applicators required complex parts or were difficult to assemble. It is with overcoming the foregoing deficiencies that the present invention is concerned.

SUMMARY OF THE INVENTION

It is accordingly one object of the present invention to provide an improved applicator which contains relatively few parts, is easy to assemble, is reliable in operation, and which will provide a long useful life. Other objects and attendant advantages of the present invention will readily be perceived hereafter.

The present invention relates to a liquid applicator comprising a valve body, a duct in said valve body, a resilient web in said duct, a valve seat on said valve body at the end of said duct, a valve member including a valve pin and a valve head on said valve pin, means interconnecting said valve pin and said resilient web for biasing said valve head onto said valve seat to prevent liquid from flowing past said valve seat into said duct when said valve head is biased onto said seat, a base on said valve body on the opposite end thereof from said valve seat, a tip on said valve pin proximate said base, and a coating member on s id base for receiving liquid from said duct when said tip of said valve pin is deflected by the application of external pressure to said coating member to cause said valve head to be unseated from said seat.

The various aspects of the present invention will be more fully understood when the following portions of the specification are read in conjunction with the accompanying drawings wherein:

BRIEF DESCRIPTION OF THE DRAWINGS

FIG. 1 is a side elevational view of a liquid container mounting the improved applicator of the present invention thereon;

FIG. 1*a* is a fragmentary view of the end of the applicator taken substantially in the direction of arrows 1*a*—1*a* of FIG. 1;

FIG. 2 is an inverted enlarged fragmentary cross sectional view taken substantially along line 2—2— of FIG. 1 showing the internal structure of the improved applicator;

FIG. 3 is a view similar to FIG. 2 but showing the position of the various parts of the applicator when the coating member is depressed to apply liquid to a surface;

FIG. 4 is a cross sectional view taken substantially along line 4—4 of FIG. 2 and showing the plurality of apertures in the web;

FIG. 5 is a fragmentary cross sectional view of a modified valve body for the applicator;

FIG. 6 is a cross sectional view taken substantially along line 6—6 of FIG. 5;

FIG. 7 is a perspective view of a modified form of applicator;

FIG. 8 is an inverted cross sectional view taken substantially along line 8—8 of FIG. 7;

FIG. 9 is a cross sectional view taken substantially along line 9—9 of FIG. 8;

FIG. 10 is a cross sectional view of another modified embodiment of the present invention which includes structure for adjusting the flow through the applicator; and FIG. 11 is a cross sectional view taken substantially along line 11—11 of FIG. 10

DESCRIPTION OF THE PREFERRED EMBODIMENTS

The improved applicator 10 of the present invention is shown in FIG. 1 as mounted on the body 11 of a liquid container, such as a shoe polish bottle, by having the central portion 12 of valve body 13 received in neck 14 of container body 11 with a sufficient interference fit to prevent flow of liquid therebetween. A cover 16, shown in phantom, has an interference fit with rib 18 of container 11. Cover 16 is removed when the applicator 10 is to be used, and it is replaced to prevent the applicator from staining surfaces which it might otherwise contact.

The valve body 13 is fabricated of a suitable elastomer, such as rubber or vinyl. It has an annular valve seat 15 at one end thereof. A web 17 is formed integrally with and extends inwardly from internal wall 19, and it divides duct 20 into an entry portion or chamber 21 and a well 22. A valve member 23 includes a valve pin 24 of metal or plastic and a circular valve head 25. Valve pin 24 includes an annular shoulder 27 proximate reduced valve pin portion 29, which is received in aperture 30 of web 17. The surface of web 17 adjacent aperture 30 bears on annular shoulder 27, and because of the resilience of web 17 and the axial dimension between shoulder 27 and surface 31 of valve head 25, the outer annular portion of valve head 25 will be biased into sealing engagement with annular seat 15 to thereby completely close off duct 20 from the inside 32 of container or bottle 11. Thus, there can be no leakage past valve head 25 into duct 20 when the parts are in the position of FIG. 2.

A coating member 33 is mounted on base 34 as by gluing. A bore 35 is located in member 33 in concentric relationship to the outer tip 37 of valve pin 24 which it receives, as shown in FIG. 2. Coating member 33 may be of any suitable material, such as open cell or closed cell foam material, such as rubber, polyurethane, or any other elastomer or any other suitable material. As can be seen from FIG. 2, tip 37 extends outwardly beyond base 34. A plurality of apertures 39 are located in web 17 through which liquid can pass from duct portion 21 into well portion 22 of duct 20.

When it is desired to dispense liquid from bottle 11, the latter is inverted and the coating member 33 is pressed against surface 40 (FIG. 3) to which liquid is to be applied. The coating member 33 will compress from the condition shown in FIG. 2 to the condition shown in FIG. 3 and this will permit the tip 37 of valve pin 24 to be moved upwardly against the bias of resilient web 17, and thus valve head 25 will be unseated from seat 15. Thus, liquid can flow into the upper chamber 21 of duct 20 and through apertures 39 into well portion 22 of duct 20 and then onto coating member 33. If the latter is an open cell foam, it will absorb the liquid and transmit it to surface 40 as the coating member is compressed. If coating member 33 is of a closed cell foam, the liquid will pass through bore 35 onto surface 40 notwithstanding that when foam 33 is compressed, it may expand into contact with tip 37. Well 22 assures a good supply of liquid to coating member 33 and bore 35.

The applicator 10 possesses numerous desirable attributes. First of all, there is no pumping required to initiate liquid flow. It is merely necessary to deflect the valve pin 24. In this respect, the valve pin 24 need not be deflected in a purely axial direction, as shown in FIG. 3. It can be deflected laterally also to unseat valve head 25. However, the resilience of web 17 will always cause valve head 25 to seat properly on seat 15 when the force is removed from coating member 33. The proper seating is enhanced because pin 24 is concentric with duct 20. Furthermore, the design is extremely simple which leads to ease of fabrication and reliability in operation. In the foregoing respect, all that is necessary to assemble the valve pin 24 into valve body 13 is to push tip 37 downwardly through web aperture 30 until the position of FIG. 2 is obtained. Additionally, the foam coating member 33 provides longer wear because of the fact that flow of liquid is readily obtained through duct 20 and web apertures 39, thereby obviating the necessity for hard-pressing and rubbing of the surface of coating member 33 onto the surface 40 to which liquid is being applied.

A modified embodiment of the body member is shown at 41 in FIGS. 5 and 6. This embodiment may be identical in all respects to the embodiment of FIGS. 1–4 except that a plurality of annular ridges 42 are formed integrally with the external surface 43 of valve body 41 to provide improved sealing with the internal surface of neck 14 of bottle 11.

A further modified embodiment of the present invention is disclosed in FIGS. 7–9. In this embodiment the valve body 45 may be substantially the same as valve body 13 except for its dimensions. In this respect, the base 47, which corresponds to base 34, is elongated and rectangular for receiving a rectangular foam coating member 49 thereon. The valve member 50 differs from valve member 23 of FIGS. 1–4 because the tip 51 is closer to shoulder 52 than corresponding parts of valve member 23. Furthermore, the coating member 49 has a blind bore 53 therein which receives tip 51, so that there is no through bore, such as 35 of FIGS. 1–4. However, all of the other parts of the valve body 45 and valve member 50 are substantially identical to the corresponding parts of FIGS. 1–4.

In the embodiment of FIGS. 7–9, the coating member 49 is open cell foam which receives its liquid from well 54, which corresponds to well 22 of FIGS. 1–4. Because of the combination of the well 54 and the open cell aspect of coating member 49, liquid can be transferred to the entire rectangular surface 55 of the coating member for application to an external surface.

In the embodiment of FIGS. 7–9, apertures 57 of web 59 are shown as being smaller than apertures 39 of FIGS. 1–4. This is merely by way of example, as it will be appreciated that the number and size of the apertures in the webs of the various embodiments can be selected for desired results with various liquids of different viscosities. By way of example, more viscous liquids would require larger openings than less viscous liquids. Furthermore, with any liquid of a given viscosity, the size and number of apertures in the web can be selected, at the time of fabrication, to give desired rates of flow through the valve body.

In FIGS. 10 and 11 another embodiment of the present invention is disclosed. In this embodiment the flow through body member 60 can be adjusted in the field. More specifically, valve body 60 includes a web 61 which has diametrically opposed arcuate slots 62 therein. An adjusting disc 63 of resilient material is mounted on rectangular portion 64 of valve pin 65 and retained thereon by annular collar 67 formed integrally with valve pin 65. More specifically, disc 63 has a square cutout 69 thereon which fits into complementary mating relationship on square portion 64 of valve pin 65. Upstanding tubular portion 70 of disc 63 also has a square internal configuration and its upper end is located in abutting relationship with collar 67. Disc 63 has a pair of diametrically opposed arcuate slots 71 therein. The slots 62 of web 61 and the slots 71 of disc 63 are dimensioned so that slots 71 can completely overlie slots 62 to provide maximum flow through web 61, or slots 71 can be in the position shown in FIG. 11 wherein they do not at all overlie slots 62, thus preventing flow through web 61. In order to adjust the amount of overlap between slots 62 and 71, a screwdriver slot 72 is provided in the tip 73 of valve pin 65 so that the valve pin can be rotated about its longitudinal axis to provide the desired degree of overlap between slots 62 and 71. The remainder of the structure of the embodiment of FIGS. 10 and 11 is analogous to the structure of the embodiment discussed above relative to FIGS. 1–4, and therefore it is deemed unnecessary to describe these additional aspects in detail.

In addition to the adjustability feature of FIGS. 10 and 11, it possesses the additional feature of disc 63 providing an additional closure to the duct through valve body 60 when slots 71 and 62 are not overlapping. In other words, disc 63, in addition to providing adjustability of flow, will also provide a closing action to prevent flow through the valve body when slots 62 and 71 are not overlapping. This position may be desirable during shipping and prolonged storage prior to use, and the ultimate consumer may rotate valve pin 65 the desired amount prior to use.

While preferred embodiment of the present invention have been disclosed, it will be appreciated that it is not limited thereto but may be otherwise embodied within the scope of the following claims.

What is claimed is:

1. A liquid applicator comprising a molded valve body, a duct having first and second ends in said valve body, an internal surface in said molded valve body defining said duct, a resilient web in said duct, said resilient web extending inwardly from said internal surface and formed integrally with said molded valve body, a first aperture in said resilient web, a valve seat on said valve body at said first end of said duct, a valve member including a valve pin and a valve head on said valve pin, said valve pin being a separate member from said web, a portion of reduced diameter on said valve pin extending through said first aperture, a shoulder on said valve pin proximate said portion of reduced diameter for effectively bearing on the opposite side of said resilient web from said valve seat at the border of said first aperture for biasing said valve head onto said valve seat to prevent liquid from flowing past said valve seat into said duct, at least one permanently open second aperture in said resilient web spaced from said first aperture, a base on said valve body proximate said second end of said duct, a tip on said valve pin proximate said base, and a coating member on said base for receiving liquid from said duct when said tip of said valve pin is deflected by the application of an external force to said coating member to cause said valve head to be unseated form said seat against the bias of said resilient web.

2. A liquid applicator as set forth in claim 1 wherein said coating member comprises a foam member, and an opening in said foam member for receiving said tip of said valve pin.

3. A liquid applicator as set forth in claim 2 wherein said opening extends entirely through said foam member.

4. A liquid applicator as set forth in claim 1 including a well in said duct between said web and said base.

5. A liquid applicator as set forth in claim 4 wherein said coating member comprises a foam member, and an opening in said foam member for receiving said tip of said valve pin.

6. A liquid applicator as set forth in claim 5 wherein said opening extends entirely through said foam member.

7. A liquid applicator as set forth in claim 4 including aperture means in said web for permitting flow of liquid past said web.

8. A liquid applicator as set forth in claim 1 including means for adjusting the amount of a continuous flow through said at least one second aperture in said web.

9. A liquid applicator as set forth in claim 8 wherein said last-mentioned means comprises means for obstructing said at least one second aperture varying amounts.

10. A liquid applicator as set forth in claim 9 wherein said last-mentioned means comprises an apertured plate secured to said valve pin, and means for rotating said apertured plate relative to said resilient web.

11. A liquid applicator as set forth in claim 9 including a well in said duct between said web and said base.

12. A liquid applicator comprising a valve body having a longitudinal axis, a duct having first and second ends in said valve body, an internal surface in said valve body defining said duct, a disk-like resilient web formed integrally with and extending inwardly from said internal surface, said disk-like resilient web extending substantially perpendicularly to said longitudinal axis, a first aperture in said resilient web, a valve seat on said valve body at said first end of said duct, an entry chamber between said valve seat and said resilient web, a well on the opposite side of said resilient web from said entry chamber, a valve member including a valve pin and a valve head on said valve pin, said valve pin being a separate member from said resilient web and including a portion of reduced diameter extending through said first aperture in said resilient web with a close fit, said valve member being rigid throughout its extent and including a rigid shoulder on said valve pin proximate said portion of reduced diameter, said shoulder being located on the opposite side of said resilient web from said valve seat for effectively bearing on said resilient web at the border of said first aperture with which it has a close fit for biasing said valve head onto said valve seat to prevent liquid from flowing past said valve seat into said entry chamber of said duct when said valve head is biased onto said valve seat, at least one permanently open second aperture in said resilient web spaced from said first aperture, a base on said valve body on the opposite end thereof from said valve seat proximate said second end of said duct, a tip on said valve pin proximate said base, and a coating member on said base for receiving liquid which passes into said entry chamber and through said at least one second aperture and through said well of said duct when said pin is deflected by the application of an external force to said coating member to cause said valve head to be unseated from said seat against the bias of said resilient web.

13. A liquid applicator comprising a valve body, a duct having first and second ends in said valve body, an internal surface in said valve body defining said duct, a disk-like resilient web in said duct, said resilient web extending inwardly from said internal surface and formed integrally with said valve body, a first aperture in said resilient web, a valve seat on said valve body at said first end of said duct, an entry chamber between said valve seat and said resilient web, a well on the opposite side of said resilient web from said entry chamber, a valve member including a valve pin and a valve head on said valve pin, said valve pin being a separate member from said resilient web and including a portion of reduced diameter extending through said first aperture in said resilient web with a close fit, said valve member being rigid throughout its extent and including a rigid shoulder on said valve pin proximate said portion of reduced diameter, said shoulder being located on the opposite side of said resilient web from said valve seat for effectively bearing on said resilient web at the border of said first aperture with which it has a close fit for biasing said valve head onto said valve seat to prevent liquid from flowing past said valve seat into said entry chamber of said duct when said valve head is biased onto said valve seat, said valve pin and said shoulder being of smaller diameter than said valve head and of smaller diameter than said entry chamber and said well, said entry chamber including an opening at said first end of said duct within said valve seat which is of greater diameter than said valve pin and of greater diameter than said shoulder, at least one permanently open second aperture in said resilient web spaced from said first aperture, a base on said valve body on the opposite end thereof from said valve seat proximate said second end of said duct, a tip on said valve pin proximate said base, and a coating member on said base for receiving liquid which passes into said entry chamber and through said at least one permanently open second aperture and through said well of said duct when said tip of said valve pin is deflected by the application of an external force to said coating member to cause said valve head to be unseated from said seat against the bias of said resilient web, said bearing between said shoulder of said valve pin and said web and said close fit between said portion of reduced diameter and said first aperture causing said valve head to positively return to a closed position on said valve seat when said external force is removed from said coating member.

* * * * *